US010777885B2

(12) United States Patent
Timofeev et al.

(10) Patent No.: US 10,777,885 B2
(45) Date of Patent: Sep. 15, 2020

(54) DUAL-BEAM SECTOR ANTENNA AND ARRAY

(71) Applicant: CommScope Technologies LLC, Hickory, NC (US)

(72) Inventors: Igor E. Timofeev, Dallas, TX (US); Martin L. Zimmerman, Chicago, IL (US); Huy Cao, Garland, TX (US); Yanping Hua, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 308 days.

(21) Appl. No.: 15/787,782

(22) Filed: Oct. 19, 2017

(65) Prior Publication Data

US 2018/0062258 A1 Mar. 1, 2018

Related U.S. Application Data

(63) Continuation of application No. 13/127,592, filed as application No. PCT/US2009/006061 on Nov. 12, 2009, now Pat. No. 9,831,548.
(Continued)

(51) Int. Cl.
*H01Q 3/00* (2006.01)
*H01Q 3/26* (2006.01)
(Continued)

(52) U.S. Cl.
CPC ..... *H01Q 3/26* (2013.01); *H01Q 1/246* (2013.01); *H01Q 3/30* (2013.01); *H01Q 25/002* (2013.01);
(Continued)

(58) Field of Classification Search
CPC ..... H01Q 3/26; H01Q 3/263; H01Q 3/267; H01Q 3/28; H01Q 3/30; H01Q 3/40; H01Q 25/002; H01Q 25/02
(Continued)

(56) References Cited

U.S. PATENT DOCUMENTS 4,584,581 A 4/1986 Teshirogi
4,638,317 A 1/1987 Evans
(Continued)

FOREIGN PATENT DOCUMENTS

CA 2540218 9/2007
CA 2645720 9/2007
(Continued)

OTHER PUBLICATIONS

Examination Report for corresponding European Patent Application No. 09 827 850.0-1568, dated Dec. 12, 2017, 4 pages.
(Continued)

*Primary Examiner* — Chuong P Nguyen
(74) *Attorney, Agent, or Firm* — Myers Bigel, P.A.

(57) ABSTRACT

A low sidelobe beam forming method and dual-beam antenna schematic are disclosed, which may preferably be used for 3-sector and 6-sector cellular communication system. Complete antenna combines 2-, 3- or -4 columns dual-beam sub-arrays (modules) with improved beam-forming network (BFN). The modules may be used as part of an array, or as an independent 2-beam antenna. By integrating different types of modules to form a complete array, the present invention provides an improved dual-beam antenna with improved azimuth sidelobe suppression in a wide frequency band of operation, with improved coverage of a desired cellular sector and with less interference being created with other cells. Advantageously, a better cell efficiency is realized with up to 95% of the radiated power being directed in a desired cellular sector.

22 Claims, 10 Drawing Sheets

Related U.S. Application Data

(60) Provisional application No. 61/199,840, filed on Nov. 20, 2008.

(51) Int. Cl.

| | |
|---|---|
| ***H01Q 3/30*** | (2006.01) |
| ***H01Q 25/00*** | (2006.01) |
| ***H01Q 1/24*** | (2006.01) |
| *H01Q 25/02* | (2006.01) |
| *H01Q 3/28* | (2006.01) |
| *H01Q 3/40* | (2006.01) |
| *H01Q 21/06* | (2006.01) |
| *H01Q 21/24* | (2006.01) |

(52) U.S. Cl.
CPC ..... *H01Q 3/28* (2013.01); *H01Q 3/40* (2013.01); *H01Q 21/061* (2013.01); *H01Q 21/24* (2013.01); *H01Q 25/00* (2013.01); *H01Q 25/02* (2013.01)

(58) Field of Classification Search
USPC ..... 342/373, 374, 380, 383
See application file for complete search history.

(56) References Cited

U.S. PATENT DOCUMENTS

| | | | | |
|---|---|---|---|---|
| 5,115,248 | A * | 5/1992 | Roederer | H01Q 3/2658 342/368 |
| 5,177,491 | A | 1/1993 | Lopez | |
| 5,581,260 | A | 12/1996 | Newman | |
| 5,666,655 | A | 9/1997 | Ishikawa et al. | |
| 5,686,926 | A * | 11/1997 | Kijima | H01Q 25/00 342/373 |
| 5,907,816 | A | 5/1999 | Newman et al. | |
| 6,034,649 | A | 3/2000 | Wilson et al. | |
| 6,081,233 | A | 6/2000 | Johannisson | |
| 6,094,165 | A | 7/2000 | Smith | |
| 6,127,972 | A | 10/2000 | Avidor et al. | |
| 6,167,036 | A | 12/2000 | Beven | |
| 6,198,434 | B1 * | 3/2001 | Martek | H01Q 3/40 342/373 |
| 6,311,075 | B1 | 10/2001 | Bevan et al. | |
| 6,317,100 | B1 * | 11/2001 | Elson | H01Q 21/22 343/833 |
| 6,463,301 | B1 | 10/2002 | Bevan et al. | |
| 6,463,303 | B1 | 10/2002 | Zhao | |
| 6,480,524 | B1 | 11/2002 | Smith et al. | |
| 6,608,591 | B2 * | 8/2003 | Wastberg | H01Q 1/246 342/373 |
| 7,038,621 | B2 | 5/2006 | Gabriel et al. | |
| 7,098,848 | B2 * | 8/2006 | Ksienski | H01Q 21/061 342/372 |
| 7,102,571 | B2 * | 9/2006 | McCarrick | H01Q 1/38 343/700 MS |
| 7,327,323 | B2 | 2/2008 | Jackson et al. | |
| 7,388,552 | B2 | 6/2008 | Mori | |
| 7,400,606 | B2 | 7/2008 | Padovani et al. | |
| 7,792,547 | B1 | 9/2010 | Smith et al. | |
| 8,269,687 | B2 * | 9/2012 | Lindmark | H01Q 1/246 343/810 |
| 9,077,083 | B1 * | 7/2015 | Freeman | H01Q 21/24 |
| 9,768,494 | B2 * | 9/2017 | Johansson | H01Q 1/246 |
| 10,263,331 | B2 * | 4/2019 | Kundtz | H01Q 3/30 |
| 10,454,164 | B2 * | 10/2019 | Yoshihara | H01Q 21/06 |
| 2004/0235528 | A1 | 11/2004 | Korisch | |
| 2009/0096702 | A1 | 4/2009 | Vassilakis et al. | |
| 2015/0084832 | A1 * | 3/2015 | Ai | H01Q 1/246 343/893 |
| 2015/0333884 | A1 * | 11/2015 | Athley | H04L 5/0048 375/295 |

FOREIGN PATENT DOCUMENTS

| | | | |
|---|---|---|---|
| CN | 1540903 | A | 10/2004 |
| CN | 1921341 | | 2/2007 |
| CN | 101051860 | | 10/2007 |
| EP | 0 895 436 | | 2/1999 |
| IN | 240893 | A1 | 6/2010 |
| JP | 2006066993 | | 3/2006 |
| WO | WO 99/60659 | | 11/1999 |
| WO | WO 2001015477 | A1 | 3/2001 |
| WO | WO 02/041450 | | 5/2002 |
| WO | WO 2002049150 | A2 | 6/2002 |
| WO | WO 2002102106 | A1 | 12/2002 |
| WO | WO 03/043127 | | 5/2003 |
| WO | WO 2003045094 | A1 | 5/2003 |
| WO | WO 2004032393 | A2 | 4/2004 |
| WO | WO 2005053182 | A1 | 6/2005 |
| WO | PCT/SE05/000643 | | 11/2005 |
| WO | WO 2006/004463 | A1 | 1/2006 |
| WO | WO 2007/106989 | A1 | 9/2007 |
| WO | WO 2010/059186 | A2 | 5/2010 |

OTHER PUBLICATIONS

Translation of Examination Report in corresponding Indian Patent Application No. 3562/CHENP/2011 (5 pages).

Tenx Wireless "Higher Capacity Through Multiple Beams Using Asymmetric Azimuth Arrays" Presentation given at CDG Technology Forum; Apr. 20, 2006; pp. 1-28.

Osserian et al. "System Performance of Transmit Diversity Methods and a Two Fixed-Beam System in WCDMA" Wireless Personal Communications 31-33-50; 2004.

Mobile Dev Design; Wireless Solution Boosts Network Capacity; Mar. 1, 2006.

Saunders "Antennas and Propagation for Wireless Communication Systems" Wiley, 1999, New York.

Wacker et al. "The impact of the Base Station Sectorisation on WCDMA Radio Network Performance" Proceeding of the IEEE Vehicular Communications Technology Conference, VTC 1999, Houston, Texas, May 1999, pp. 2611-2615.

Hall et al. "Review of Radio Frequency Beamforming Techniques for Scanned and Multiple Beam Antennas" Microwaves, Antennas and Propagation, IEE Proceedings H (vol. 137, Iss. 5) Oct. 1990; pp. 293-303.

Allen et al. "A Theoretical Limitation on the Formation of Lossless Multiple Beams in Linear Arrays" Antennas and Propagation, IRE Transactions (vol. 9, Iss. 4) Jul. 1961; pp. 350-352.

Taylor et al. "Design of Line-Source Antennas for Narrow Beamwidth and Low Side Lobes" Antennas and Propagation (vol. 3, Iss. 1) Jan. 1955; pp. 16-28.

Van Veen et al. "Beamforming; A Versatile Approach to Spatial Filtering" IEEE ASSP Magazine Apr. 1988, pp. 4-24.

Johnson; Antenna Engineering Handbook; 3rd Ed. McGraw Hill; 1993.

Dolph "A Current Distribution for Broadside Arrays Which Optimizes the Relationship Between Beam Width and Side-lobe Level" Proceedings of the IRE (vol. 34, Iss. 6) Jun. 1946.

Elliott Design of Line source antennas for narrow beamwidth and asymmetric low sidelobes: IEEE Trans. AP, Jan. 1975, pp. 100-107.

Osseiran et al. "Downlink Capacity Comparison between Different Smart antenna Concepts in a Mixed Service MCDMA System" pp. 1-5.

Metawave Communications Corporation; Spotlight 2000's Sitesculptor Software ; Redmond, WA 2000.

Metawave Communications Corporation; A Spotlight 2000 Case Study; SpotLight 2000 Six-Sector Configuration Delivers 74% Capacity Increase for CDMA Cell Site; Redmond, WA 2001.

Metawave Communications Corporation; Spotlight 2210 CDMA System for the Nortel Networks CDMA Metro Cell; Redmond, WA 2001.

Metawave Communications Corporation; Spotlight 2210 CDMA System for the Motorola SC 4812 Cell site; Redmond, WA 2001.

(56) References Cited

OTHER PUBLICATIONS

Gordon; Smart Cell Site Optimization; CDMA Solutions Seminar Series (Seminar Two) Metawave Communications Corporation; Redmond, WA pp. 1-16.
Osseiran et al System Performance of Multi-Beam Antennas for HS-DSCH WCDMA System ; pp. 1-5.
Ji-Hae Yea "Make six-sector work using smart antennas Part 2" Metawave Communications Corp.; Redmond, WA; pp. 1-8.
Frequency Phase Effects of Antennas; pp. 3-4.1-3-4.4.
Ho et al.; Analysis of electrically large Patch Phased Arrays via CFDTD; U.S. Government work pp. 1571-1574.
Osseiran et al. "A Method for Designing Fixed Multibeam Antenna Arrays in WCDMA Systems" IEEE Antennas and Wireless Propagations Letters, vol. 5, 2006; pp. 41-44.
Osseiran "Advanced Antennas in Wireless Communications" Doctoral Thesis; Royal Institute of Technology; Stockhold, Sweden 2006 pp. 1-223.
Hagerman et al. "SCDMA 6-sector Deployment—Case Study of a Real Installed UMTS-FDD Network" IEEE 2006, pp. 703-707.
Thornton "A Low Sidelobe Asymmetric Beam Antenna for High Altitude Platform Communications" IEEE Microwave and Wireless Components Letters, vol. 14, No. 2, Feb. 2004; pp. 59-61.
Zetterberg "Performance of Three, Six, Nine and Twelve Sector Sites in CDMA—Based on Measurements" Royal Institute of Technology; Stockholm ; IEEE 2004.
Pedersen et al. "Application and Performance of Downlink Beamforming Techniques in UMTS" IEEE Communications Magazine; Oct. 2003; pp. 134-143.
Martinez-Munoz; Nortel Networks CDMA Advantages of AABS Smart Antenna Technology for CDG; Presentation Nortel Networks; Oct. 1, 2002.
Feuerstein; Smart antennas are a practical, economical solution to many challenges faced by wireless operators; Wireless Design & Development.
Ericson et al; Capacity Study for Fixed Multi Beam Antenna systems in a Mixed Service WCDMA System; IEEE 2001; pp. A31-A35.
Kalinichev "analysis of Beam-Steering and Directive Characteristics of Adaptive Antenna Arrays for Mobile Communications" IEEE Antennas and Propagation Magazine, vol. 43, No. 3, Jun. 2001; pp. 145-152.
Spotlight 2000 Installation Manual for Motorola HD II Cellular Sites; Document 5000-0021-02; Jun. 4, 1999; pp. 1-188.
Navel Air System Command; Electronic Warfare and Radar Systems Engineering Handbook; Point Mugu, CA; Apr. 1, 1999; pp. 1-299.
Feuerstein; Applications of Smart Antennas in Cellular Networks; IEEE Personal Communications; Jun. 1999; pp. 74-86.
Anderson et al. "Adaptive Antennas for GSM and TDMA Systems" IEEE Personal Communications Jun. 1999; pp. 74-86.
Cheston et al. Time-Delay Feed Architectures for Active Scanned Arrays; IEEE 1999; pp. 1620-1623.
Lin et al. "Performance of an Angle-of-Arrival Estimator in the Presence of a Mainbeam Interference Source" Navel Research Laboratory; Washington, DC NRL Report 9345 Aug. 21, 1991; pp. 1-13.
Schuman "Minimizing the Number of Control Elements in Phased Arrays by Subarraying" IEEE 1988; pp. 1094-1097.
Frank "Phased Array Antenna Development" Johns Hopkins University; Springfield VA; Mar. 1967; pp. 1-166.
TenXc Wireless Wideband Bi-Sector Array, Apr. 12, 2007, Model BSA-W65-20F004—Preliminary.
TenXc Wireless 4-Column array, Apr. 14, 2008, http://www.tenxc.com/technology.php.
Notification of the First Office Action regarding related Chinese Patent Application No. 201310716957.1, dated May 11, 2015 (6 pgs.).
Search Report regarding related Chinese Patent Application No. 201310716957.1, dated May 11, 2015 (2 pgs.).
Notification of the First Office Action, State Intellectual Property Office (SIPO) of The People's Republic of China, Chinese Application No. 201310716957.1, Search Report.
Chinese Office Action for related application No. 200980151807.2 dated Oct. 18, 2013.
Chinese Office Action for related application No. 200980151807.2 dated Apr. 2, 2013.
Osseiran et al., "Smart Antennas in a WCDMA Radio Network System: Modeling and Evaluations," IEEE Transaction on Antennas and Propagation, vol. 54, No. 11, Nov. 2006, pp. 3302-3316.
Osseiran et al., "Impact of Angular spread on Higher order Sectorization in WCDMA Systems," 2005 IEEE 16$^{th}$ International Symposium on Personal, Indoor and Mobile Radio Communications, pp. 301-305.
Pattan, Bruno "The Versatile Butler Matrix," Microwave Journal, Nov. 2004.
Fitchard, Kevin "Sculpting Radio Waves," Wireless Review, Apr. 3, 2006.
Yea, Ji-Hae "Smart antennas for Multiple Sectorization in CDMA Cell sites," RF tx/rx (www.rfdesign.com), Apr. 2001 pp. 28-38.

* cited by examiner

DUAL-BEAM SECTOR ANTENNA AND ARRAY

CLAIM OF PRIORITY

This application is a continuation of U.S. patent application Ser. No. 13/127,592, filed May 4, 2011, which is a 35 U.S.C. § 371 national stage application of PCT International Application No. PCT/US2009/006061, filed Nov. 12, 2009 (published as WO 2010/059186 on May 27, 2010), which itself claims priority of Provisional Application U.S. Ser. No. 61/199,840, filed on Nov. 20, 2008 entitled Dual-Beam Antenna Array, the disclosures and contents of which are incorporated herein by reference in their entireties.

FIELD OF THE INVENTION

The present invention is generally related to radio communications, and more particularly to multi-beam antennas utilized in cellular communication systems.

BACKGROUND OF THE INVENTION

Cellular communication systems derive their name from the fact that areas of communication coverage are mapped into cells. Each such cell is provided with one or more antennas configured to provide two-way radio/RF communication with mobile subscribers geographically positioned within that given cell. One or more antennas may serve the cell, where multiple antennas commonly utilized and each are configured to serve a sector of the cell. Typically, these plurality of sector antennas are configured on a tower, with the radiation beam(s) being generated by each antenna directed outwardly to serve the respective cell.

In a common 3-sector cellular configuration, each sector antenna usually has a 65° 3 dB azimuth beamwidth (AzBW). In another configuration, 6-sector cells may also be employed to increase system capacity. In such a 6-sector cell configuration, each sector antenna may have a 33° or 45° AzBW as they are the most common for 6-sector applications. However, the use of 6 of these antennas on a tower, where each antenna is typically two times wider than the common 65° AzBW antenna used in 3-sector systems, is not compact, and is more expensive.

Dual-beam antennas (or multi-beam antennas) may be used to reduce the number of antennas on the tower. The key of multi-beam antennas is a beamforming network (BFN). A schematic of a prior art dual-beam antenna is shown in FIG. 1A and FIG. 1B. Antenna 11 employs a 2×2 BFN 10 having a 3 dB 90° hybrid coupler shown at 12 and forms both beams A and B in azimuth plane at signal ports 14 (2×2 BFN means a BFN creating 2 beams by using 2 columns). The two radiator coupling ports 16 are connected to antenna elements also referred to as radiators, and the two ports 14 are coupled to the phase shifting network, which is providing elevation beam tilt (see FIG. 1B). The main drawback of this prior art antenna as shown in FIG. 1C is that more than 50% of the radiated power is wasted and directed outside of the desired 60° sector for a 6-sector application, and the azimuth beams are too wide (150°@−10 dB level), creating interference with other sectors, as shown in FIG. 1D. Moreover, the low gain, and the large backlobe (about −11 dB), is not acceptable for modern systems due to high interference generated by one antenna into the unintended cells. Another drawback is vertical polarization is used and no polarization diversity.

In other dual-beam prior art solutions, such as shown in U.S. Patent application U.S. 2009/0096702 A1, there is shown a 3 column array, but which array also still generates very high sidelobes, about −9 dB.

Therefore, there is a need for an improved dual-beam antenna with improved azimuth sidelobe suppression in a wide frequency band of operation, having improved gain, and which generates less interference with other sectors and better coverage of desired sector.

SUMMARY OF INVENTION

The present invention achieves technical advantages by integrating different dual-beam antenna modules into an antenna array. The key of these modules (sub-arrays) is an improved beam forming network (BFN). The modules may advantageously be used as part of an array, or as an independent antenna. A combination of 2×2, 2×3 and 2×4 BFNs in a complete array allows optimizing amplitude and phase distribution for both beams. So, by integrating different types of modules to form a complete array, the present invention provides an improved dual-beam antenna with improved azimuth sidelobe suppression in a wide frequency band of operation, with improved coverage of a desired cellular sector and with less interference being created with other cells. Advantageously, a better cell efficiency is realized with up to 95% of the radiated power being directed in a desired sector. The antenna beams' shape is optimized and adjustable, together with a very low sidelobes/backlobes.

In one aspect of the present invention, an antenna is achieved by utilizing a M×N BFN, such as a 2×3 BFN for a 3 column array and a 2×4 BFN for a 4 column array, where M N.

In another aspect of the invention, 2 column, 3 column, and 4 column radiator modules may be created, such as a 2×2, 2×3, and 2×4 modules. Each module can have one or more dual-polarized radiators in a given column. These modules can be used as part of an array, or as an independent antenna.

In another aspect of the invention, a combination of 2×2 and 2×3 radiator modules are used to create a dual-beam antenna with about 35 to 55° AzBW and with low sidelobes/backlobes for both beams.

In another aspect of the invention, a combination of 2×3 and 2×4 radiator modules are integrated to create a dual-beam antenna with about 25 to 45° AzBW with low sidelobes/backlobes for both beams.

In another aspect of the invention, a combination of 2×2, 2×3 and 2×4 radiator modules are utilized to create a dual-beam antenna with about 25 to 45° AzBW with very low sidelobes/backlobes for both beams in azimuth and the elevation plane.

In another aspect of the invention, a combination of 2×2 and 2×4 radiator modules can be utilized to create a dual-beam antenna.

All antenna configurations can operate in receive or transmit mode.

DETAILED DESCRIPTION OF THE PREFERRED EMBODIMENT

Figure 2A:
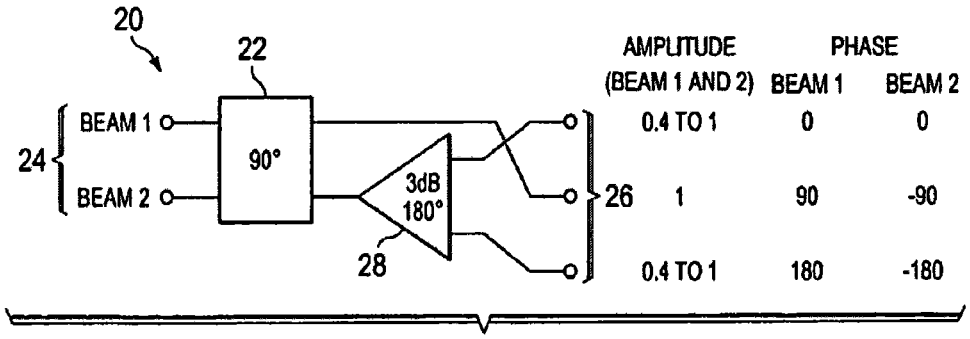
FIG. 2A shows a 2×3 BFN according to one embodiment of the present invention which forms 2 beams with 3 columns of radiators.

Referring now to FIG. 2A, there is shown one preferred embodiment comprising a bidirectional 2×3 BFN at 20 configured to form 2 beams with 3 columns of radiators, where the two beams are formed at signal ports 24. A 90° hybrid coupler 22 is provided, and may or may not be a 3 dB coupler. Advantageously, by variation of the splitting coefficient of the 90° hybrid coupler 22, different amplitude distributions of the beams can be obtained for radiator coupling ports 26: from uniform (1-1-1) to heavy tapered (0.4-1-0.4). With equal splitting (3 dB coupler) 0.7-1-0.7 amplitudes are provided. So, the 2×3 BFN 20 offers a degree of design flexibility, allowing the creation of different beam shapes and sidelobe levels. The 90° hybrid coupler 22 may be a branch line coupler, Lange coupler, or coupled line coupler. The wide band solution for a 180° equal splitter 28 can be a Wilkinson divider with a 180° Shiffman phase shifter. However, other dividers can be used if desired, such as a rat-race 180° coupler or 90° hybrids with additional phase shift. In FIG. 2A, the amplitude and phase distribution on radiator coupling ports 26 for both beams Beam 1 and Beam 2 are shown to the right. Each of the 3 radiator coupling ports 26 can be connected to one radiator or to a column of radiators, as dipoles, slots, patches etc. Radiators in column can be a vertical line or slightly offset (staggered column).

Figure 2B:
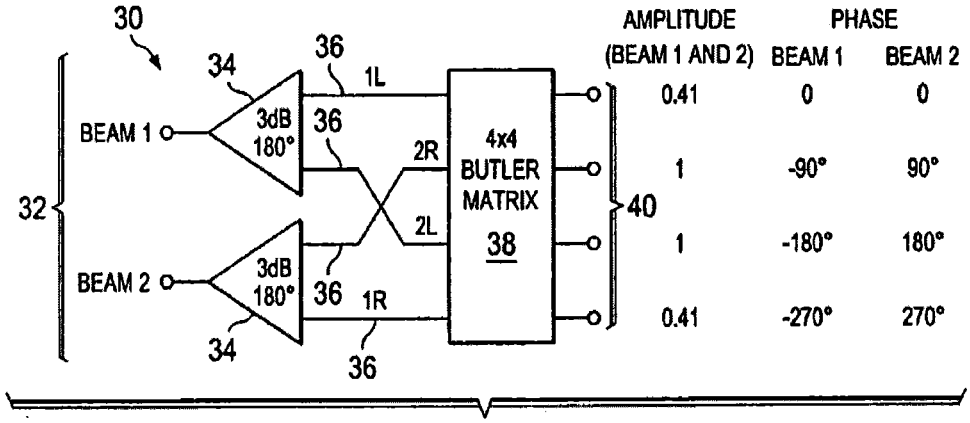
FIG. 2B is a schematic diagram of a 2×4 BFN, which forms 2 beams with 4 columns of radiators, including the associated phase and amplitude distribution for both beams.

FIG. 2B is a schematic diagram of a bidirectional 2×4 BFN 30 according to another preferred embodiment of the present invention, which is configured to form 2 beams with 4 columns of radiators and using a standard Butler matrix 38 as one of the components. The 180° equal splitter 34 is the same as the splitter 28 described above. The phase and amplitudes for both beams Beam 1 and Beam 2 are shown in the right hand portion of the figure. Each of 4 radiator coupling ports 40 can be connected to one radiator or to column of radiators, as dipoles, slots, patches etc. Radiators in column can stay in vertical line or to be slightly offset (staggered column).

Figure 2C:
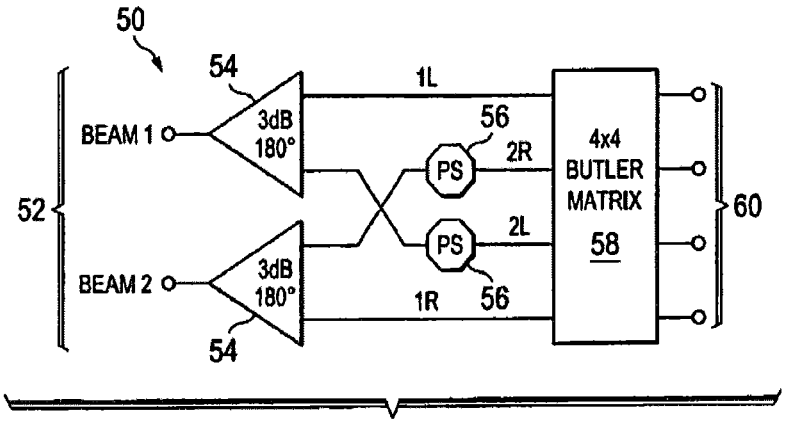
FIG. 2C is a schematic diagram of a 2×4 BFN, which forms 2 beams with 4 columns of radiators, and further provided with phase shifters allowing slightly different AzBW between beams and configured for use in cell sector optimization.

FIG. 2C is a schematic diagram of another embodiment comprising a bidirectional 2×4 BFN at 50, which is configured to form 2 beams with 4 columns of radiators. BFN 50 is a modified version of the 2×4 BFN 30 shown in FIG. 2B, and includes two phase shifters 56 feeding a standard 4×4 Butler Matrix 58. By changing the phase of the phase shifters 56, a slightly different AzBW between beams can be selected (together with adjustable beam position) for cell sector optimization. One or both phase shifters 56 may be utilized as desired.

The improved BFNs 20, 30, 50 can be used separately (BFN 20 for a 3 column 2-beam antenna and BFN 30, 50 for 4 column 2-beam antennas). But the most beneficial way to employ them is the modular approach, i.e. combinations of the BFN modules with different number of columns/different BFNs in the same antenna array, as will be described below.

Figure 1A:
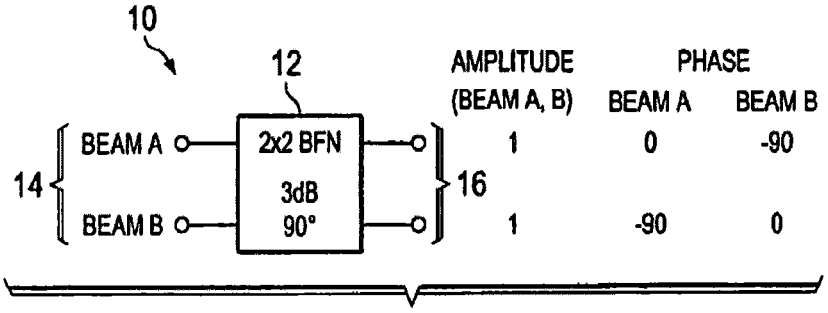
FIG. 1A (PRIOR ART)
FIGS. 1A, 1B, 1C and 1D shows a conventional dual-beam antenna with a conventional 2×2 BFN.
Figure 1B:
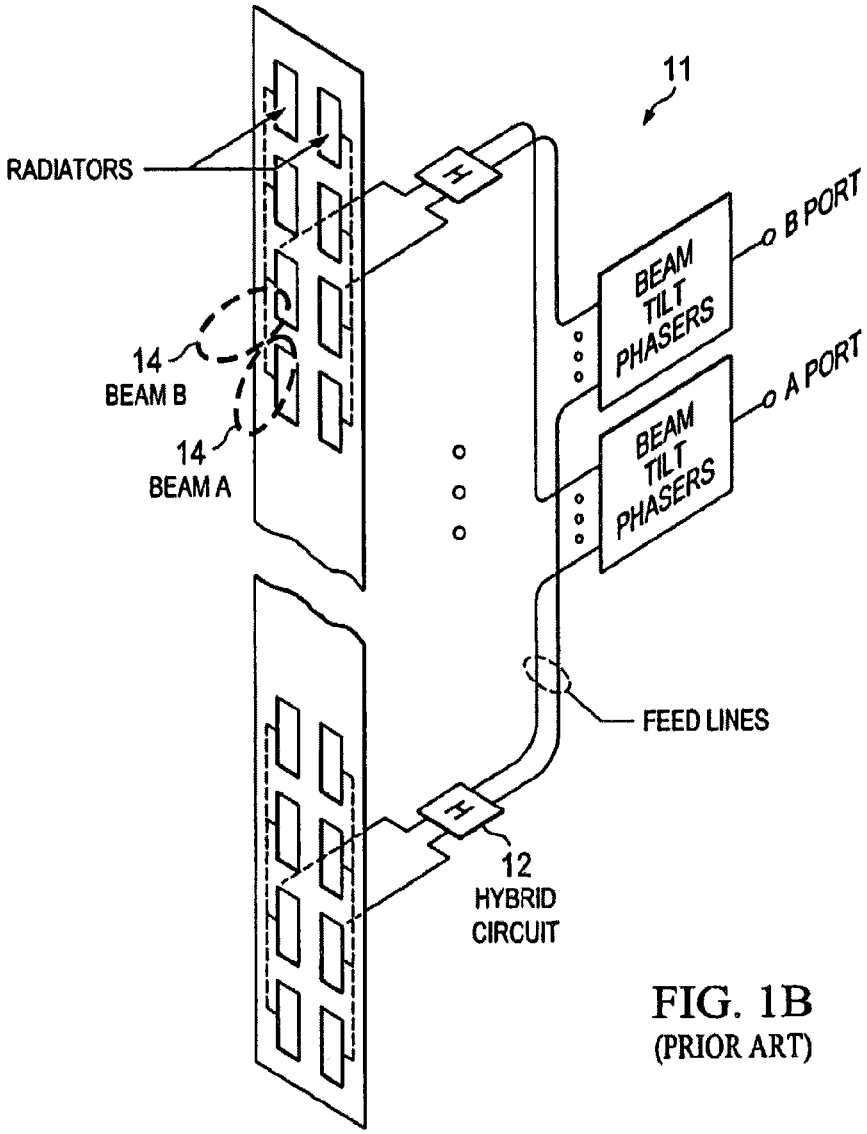
FIG. 1B (PRIOR ART)
Figure 1C:
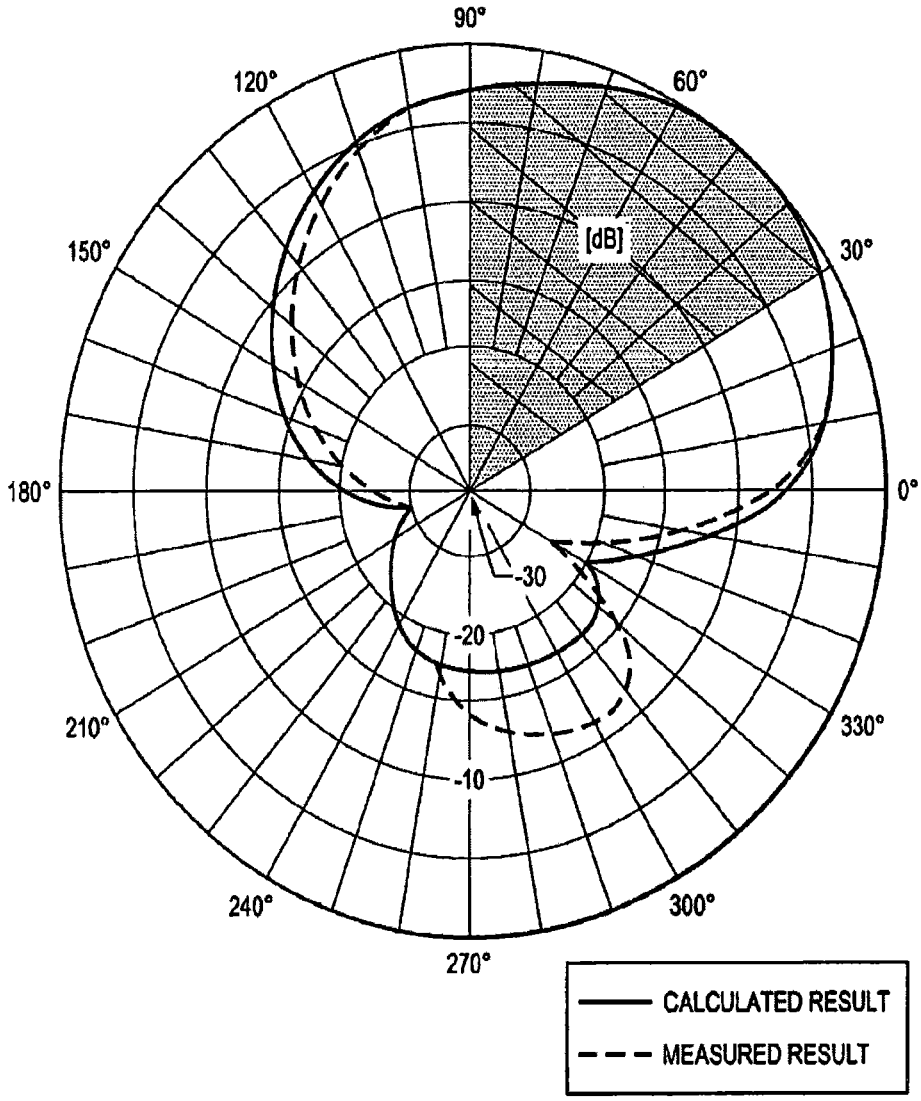
FIG. 1C (PRIOR ART)
Figure 1D:
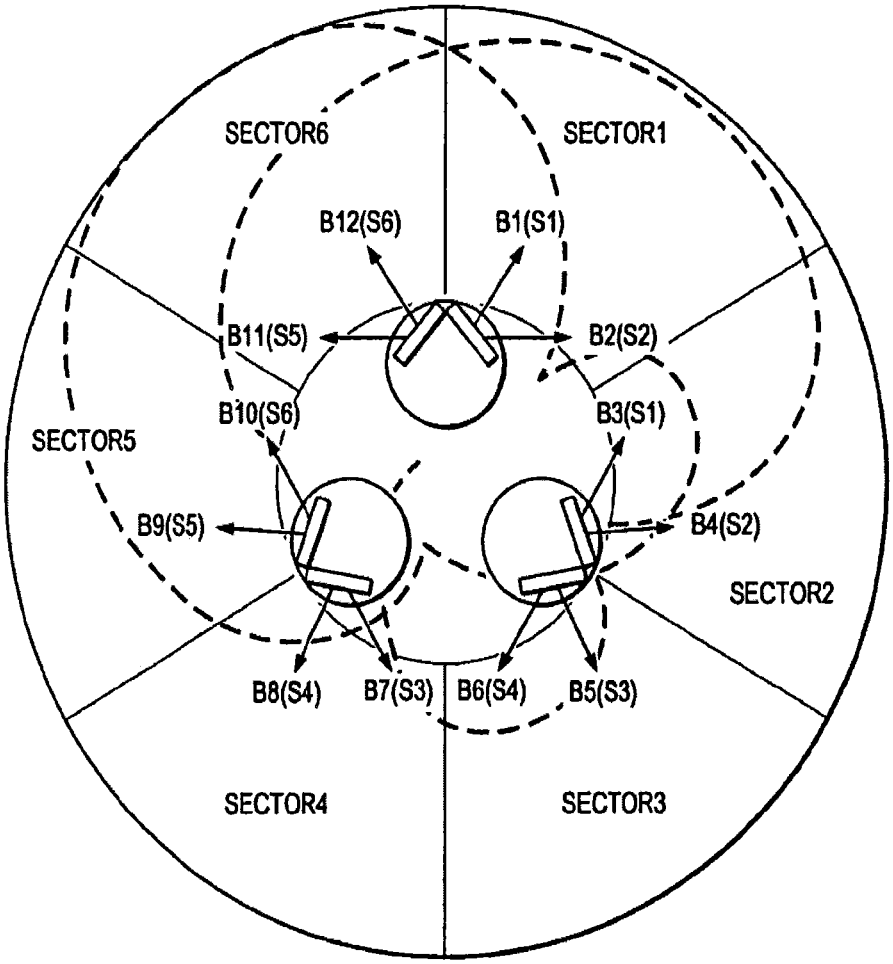
FIG. 1D (PRIOR ART)
Figure 3:
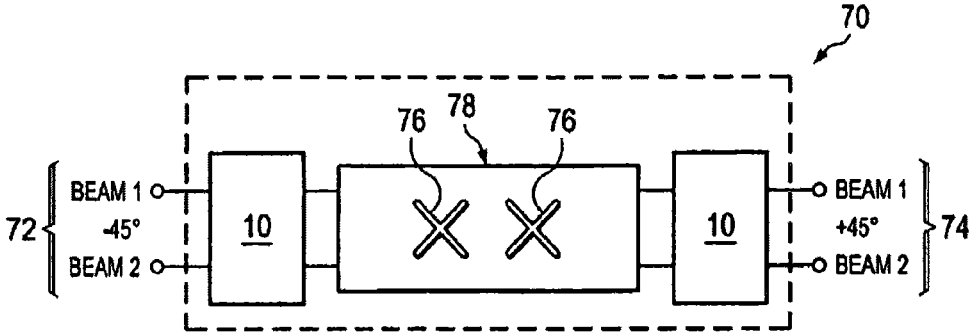
FIG. 3 illustrates how the BFNs of FIG. 1A can be advantageously combined in a dual polarized 2 column antenna module.

FIG. 3 shows a dual-polarized 2 column antenna module with 2×2 BFN's generally shown at 70. 2×2 BFN 10 is the same as shown in FIG. 1A. This 2×2 antenna module 70 includes a first 2×2 BFN 10 forming beams with −45° polarization, and a second 2×2 BFN 10 forming beams with +45° polarization, as shown. Each column of radiators 76 has at least one dual polarized radiator, for example, a crossed dipole.

Figure 4:
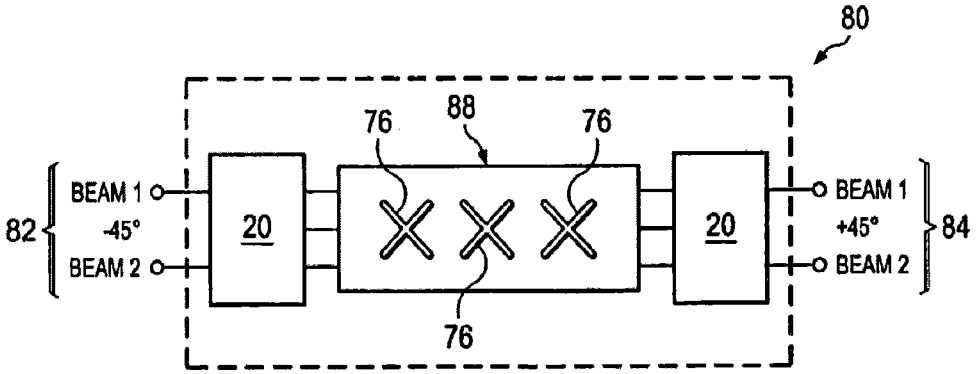
FIG. 4 shows how the BFN of FIG. 2A can be combined in a dual polarized 3 column antenna module.

FIG. 4 shows a dual-polarized 3 column antenna module with 2×3 BFN's generally shown at 80. 2×3 BFN 20 is the same as shown in FIG. 2A. This 2×3 antenna module 80 includes a first 2×3 BFN 20 forming beams with −45° polarization, and a second 2×3 BFN 20 forming beams with +45° polarization, as shown. Each column of radiators 76 has at least one dual polarized radiator, for example, a crossed dipole.

Figure 5:
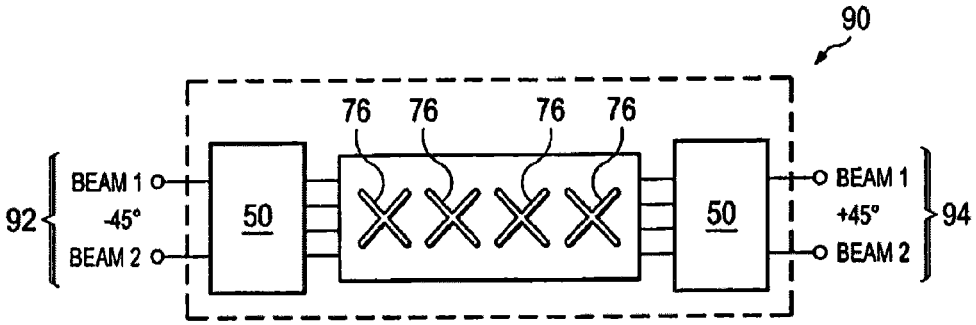
FIG. 5 shows how the BFNs of FIG. 2B or FIG. 2C can be combined in dual polarized 4 column antenna module.

FIG. 5 shows a dual-polarized 4 column antenna module with 2×4 BFN's generally shown at 90. 2×4 BFN 50 is the same as shown in FIG. 2C. This 2×4 antenna module 80 includes a first 2×4 BFN 50 forming beams with −45° polarization, and a second 2×4 BFN 50 forming beams with +45° polarization, as shown. Each column of radiators 76 has at least one dual polarized radiator, for example, a crossed dipole.

Below, in FIGS. 6-10, the new modular method of dual-beam forming will be illustrated for antennas with 45 and 33 deg., as the most desirable for 5-sector and 6-sector applications.

Figure 6:
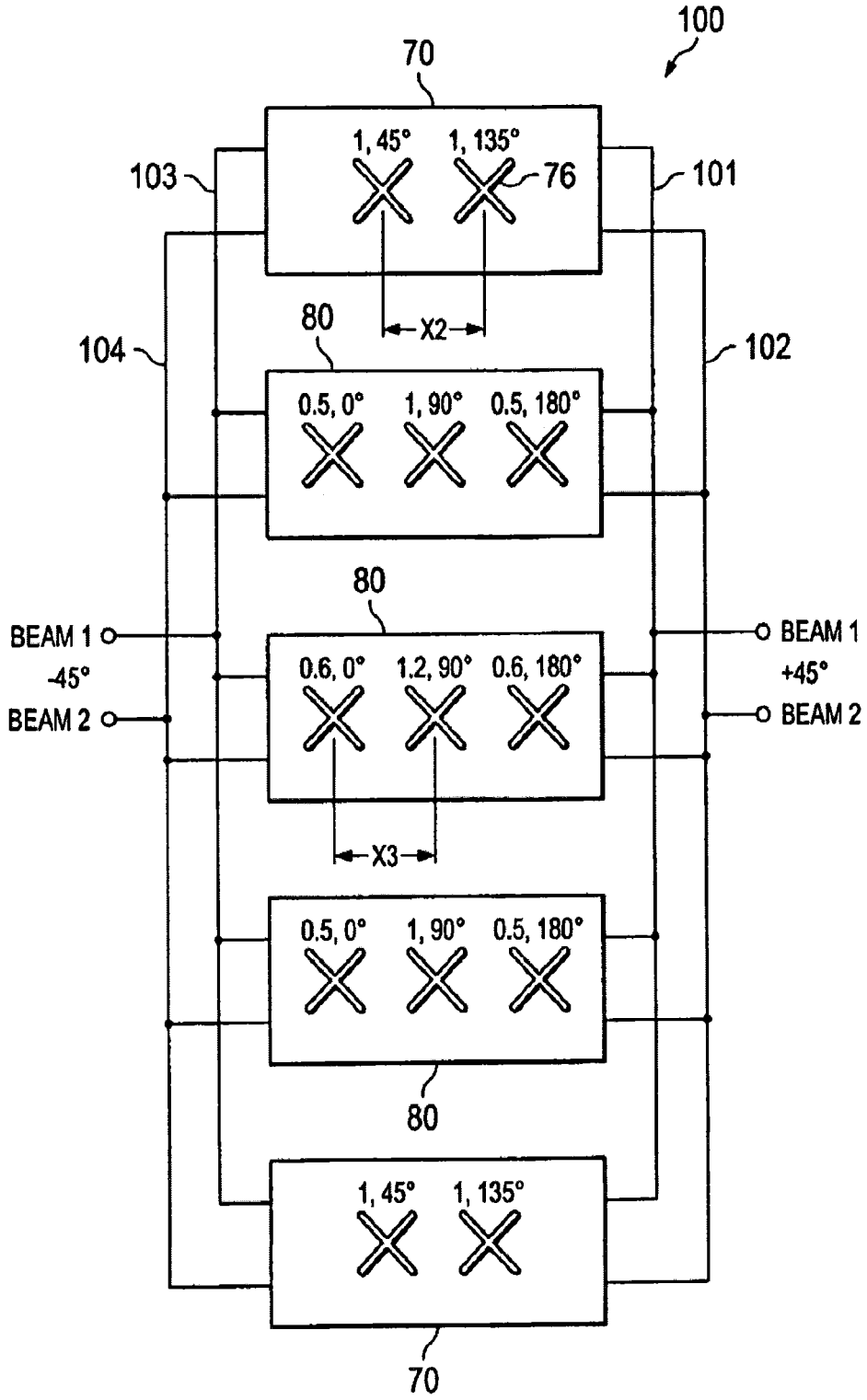
FIG. 6 shows one preferred antenna configuration employing the modular approach for 2 beams each having a 45° AzBW, as well as the amplitude and phase distribution for the beams as shown near the radiators.

Referring now to FIG. 6, there is generally shown at 100 a dual polarized antenna array for two beams each with a 45° AzBW. The respective amplitudes and phase for one of the beams is shown near the respective radiators 76. The antenna configuration 100 is seen to have 3 2×3 modules 80 s and two 2×2 modules 70. Modules are connected with four vertical dividers 101, 102, 103, 104, having 4 ports which are related to 2 beams with +45° polarization and 2 beams with −45° polarization, as shown in FIG. 6. The horizontal spacing between radiators columns 76 in module 80 is X3, and the horizontal spacing between radiators in module 70 is X2. Preferably, dimension X3 is less than dimension X2, X3<X2. However, in some applications, dimension X3 may equal dimension X2, X3=X2, or even X3>X2, depending on the desired radiation pattern. Usually the spacings X2 and X3 are close to half wavelength (λ/2), and adjustment of the spacings provides adjustment of the resulting AzBW. The splitting coefficient of coupler 22 was selected at 3.5 dB to get low Az sidelobes and high beam cross-over level of 3.5 dB.

Figure 7A:
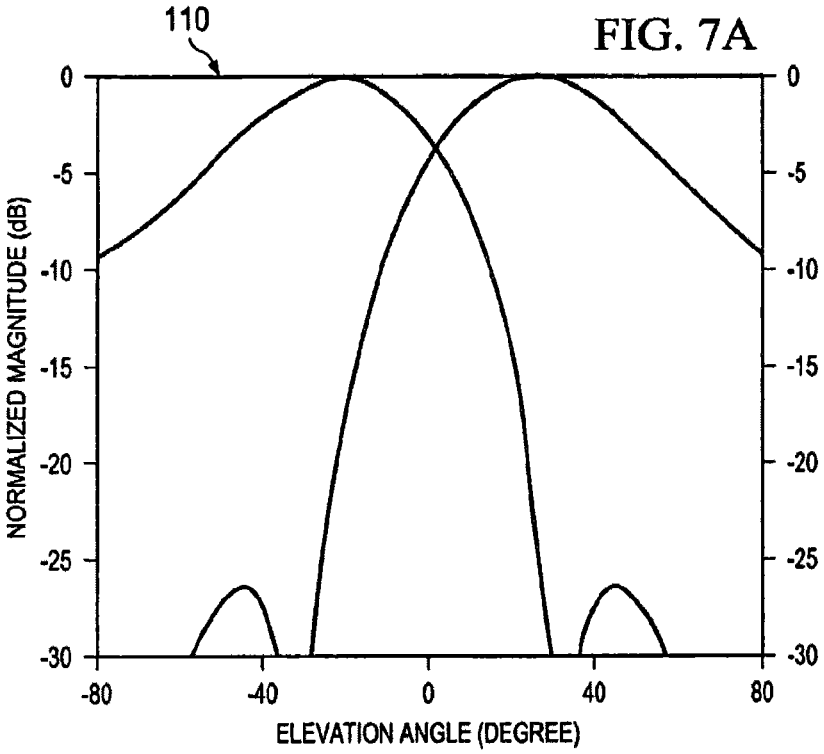
FIG. 7A and FIG. 7B show the synthesized beam pattern in azimuth and elevation planes utilizing the antenna configuration shown in FIG. 6.
Figure 7B:
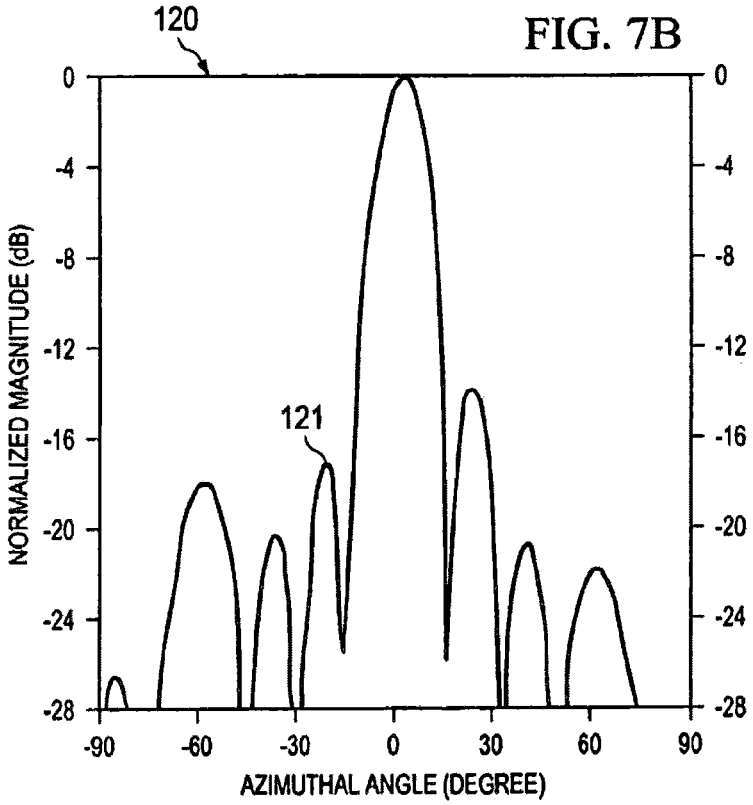

Referring to FIG. 7A, there is shown at 110 a simulated azimuth patterns for both of the beams provided by the antenna 100 shown in FIG. 6, with X3=X2=0.46λ and 2 crossed dipoles in each column 76, separated by 0.87λ As shown, each azimuth pattern has an associated sidelobe that is at least −27 dB below the associated main beam with beam cross-over level of −3.5 dB. Advantageously, the present invention is configured to provide a radiation pattern with low sidelobes in both planes. As shown in FIG. 7B, the low level of upper sidelobes 121 is achieved also in the elevation plane (<−17 dB, which exceeds the industry standard of <−15 dB). As it can be seen in FIG. 6, the amplitude distribution and the low sidelobes in both planes are achieved with small amplitude taper loss of 0.37 dB. So, by selection of a number of 2×2 and 2×3 modules, distance X2 and X3 together with the splitting coefficient of coupler 22, a desirable AzBW together with desirable level of sidelobes is achieved. Vertical dividers 101, 102, 103, 104 can be combined with phase shifters for elevation beam tilting.

Figure 8A:
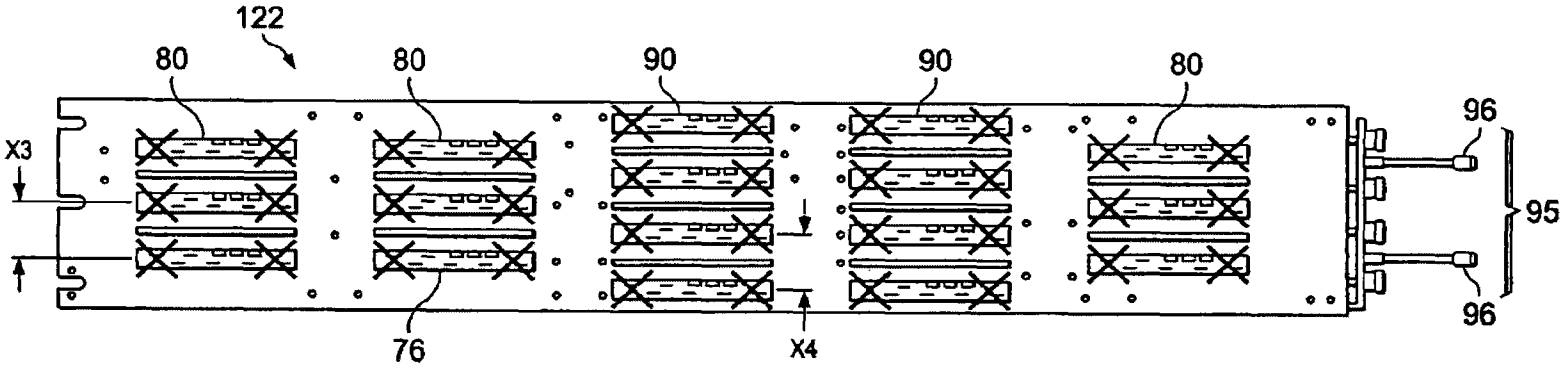
FIGS. 8A and 8B depicts a practical dual-beam antenna configuration when using 2×3 and 2×4 modules.

FIG. 8A depicts a practical dual-beam antenna configuration for a 33° AzBW, when viewed from the radiation side of the antenna array, which has three (3) 3-column radiator modules 80 and two (2) 4-column modules 90. Each column 76 has 2 crossed dipoles. Four ports 95 are associated with 2 beams with +45 degree polarization and 2 beams with −45 degree polarization.

Figure 8B:
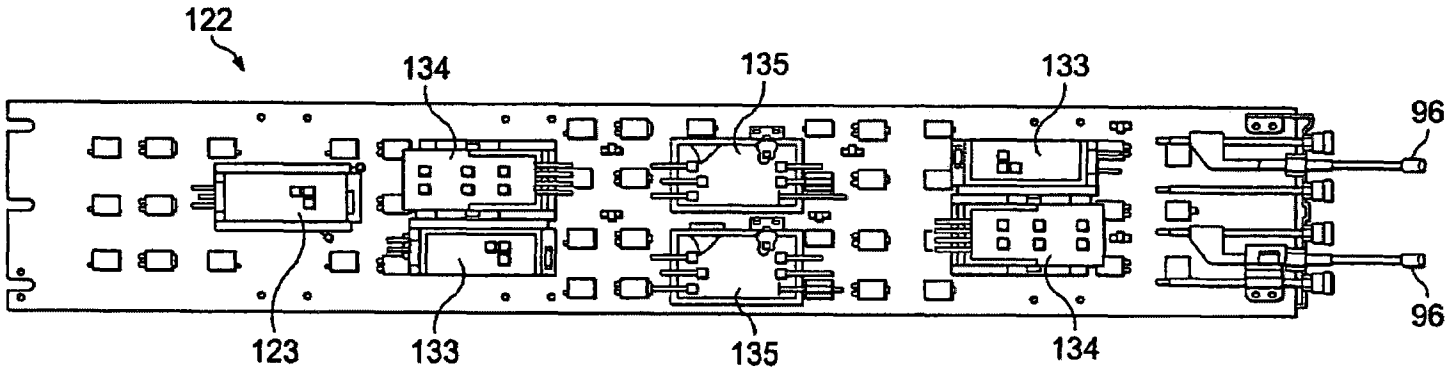

FIG. 8B shows antenna 122 when viewing the antenna from the back side, where 2×3 BFN 133 and 2×4 BFN 134 are located together with associated phase shifters/dividers 135. Phase shifters/dividers 135, mechanically controlled by rods 96, provide antenna 130 with independently selectable down tilt for both beams.

Figure 9:
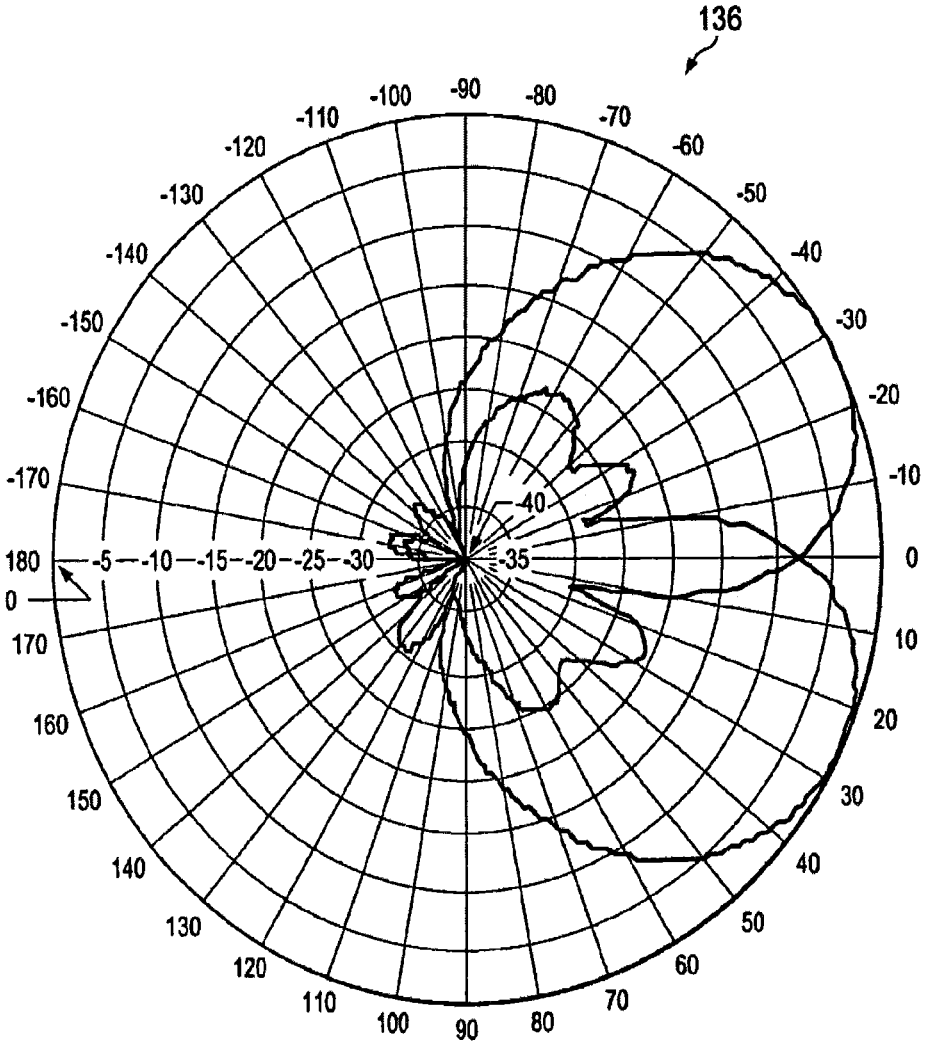
FIGS. 9-10 show the measured radiation patterns with low sidelobes for the configuration shown in FIG. 8A and FIG. 8B.

FIG. 9 is a graph depicting the azimuth dual-beam patterns for the antenna array 122 shown in FIG. 8A, 8B, measured at 1950 MHz and having 33 degree AzBW.

Figure 10:
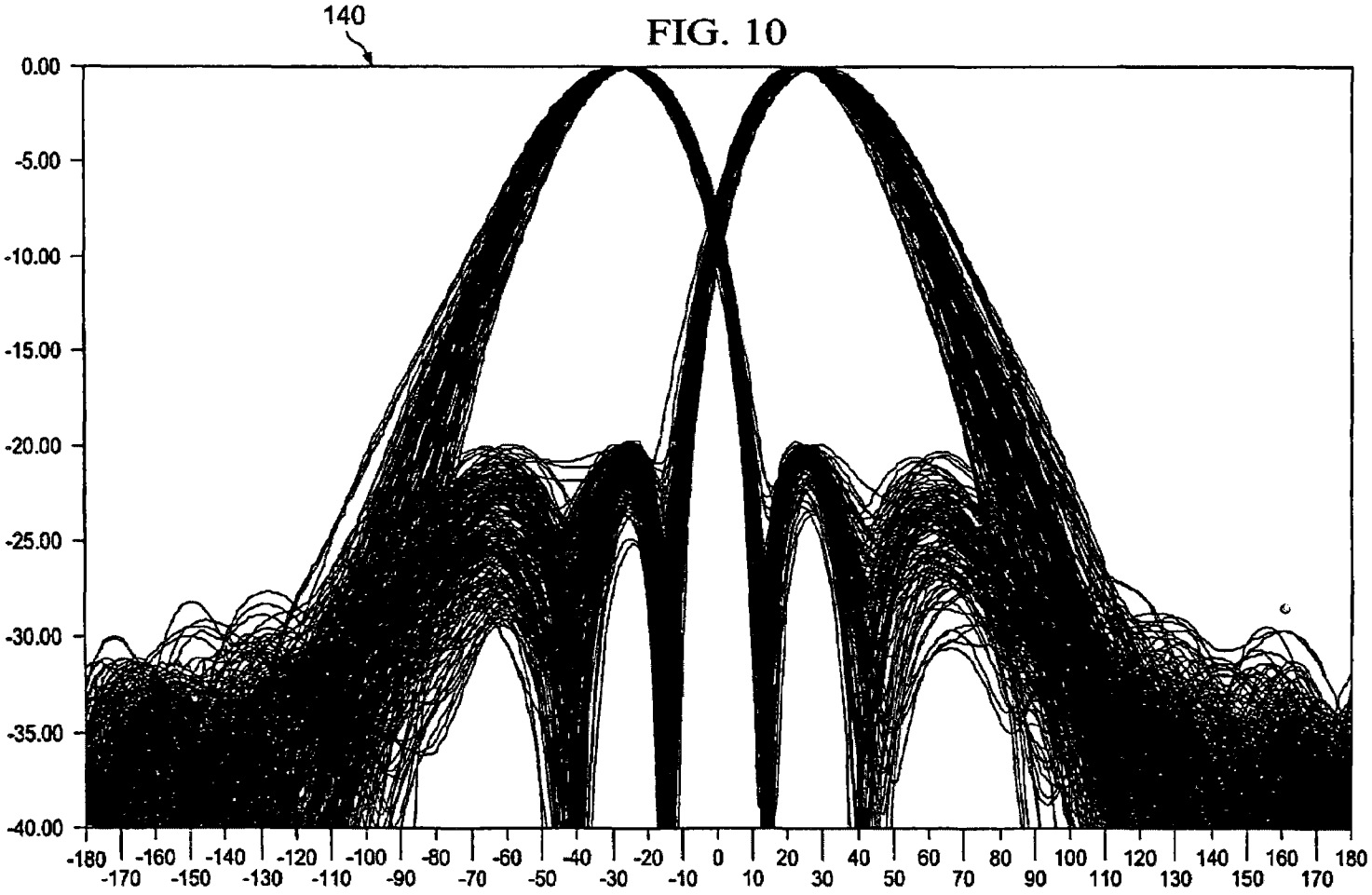

Referring to FIG. 10, there is shown at 140 the dual beam azimuth patterns for the antenna array 122 of FIG. 8A, 8B, measured in the frequency band 1700-2200 MHz. As one can see from FIGS. 9 and 10, low side lobe level (<20 dB) is achieved in very wide (25%) frequency band. The Elevation pattern has low sidelobes, too (<−18 dB).

As can be appreciated in FIGS. 9 and 10, up to about 95% of the radiated power for each main beam, Beam 1 and Beam 2, is directed in the desired sector, with only about 5% of the radiated energy being lost in the sidelobes and main beam portions outside the sector, which significantly reduces interference when utilized in a sectored wireless cell. Moreover, the overall physical dimensions of the antenna 122 are significantly reduced from the conventional 6-sector antennas, allowing for a more compact design, and allowing these sector antennas 122 to be conveniently mounted on antenna towers. Three (3) of the antennas 122 (instead of six antennas in a conventional design) may be conveniently configured on an antenna tower to serve the complete cell, with very little interference between cells, and with the majority of the radiated power being directed into the intended sectors of the cell.

For instance, the physical dimensions of 2-beam antenna 122 in FIG. 8A, 8B are 1.3×0.3 m, the same as dimensions of conventional single beam antenna with 33 degree AzBW.

In other designs based on the modular approach of the present invention, other dual-beam antennas having a different AzBW may be achieved, such as a 25, 35, 45 or 55 degree AzBW, which can be required for different applications. For example, 55 and 45 degree antennas can be used for 4 and 5 sector cellular systems. In each of these configurations, by the combination of the 2×2, 2×3 and 2×4 modules, and the associated spacing X2, X3 and X4 between the radiator columns (as shown in FIGS. 6 and 8A), the desired AzBW can be achieved with very low sidelobes and also adjustable beam tilt. Also, the splitting coefficient of coupler 22 provides another degree of freedom for pattern optimization. In the result, the present invention allows to reduce azimuth sidelobes by 10-15 dB in comparison with prior art.

Though the invention has been described with respect to a specific preferred embodiment, many variations and modifications will become apparent to those skilled in the art upon reading the present application. For example, the invention can be applicable for radar multi-beam antennas. The intention is therefore that the appended claims be interpreted as broadly as possible in view of the prior art to include all such variations and modifications.

That which is claimed is:

1. A multi-beam cellular communication antenna, comprising:

an antenna array having a plurality of rows of radiating elements, wherein a first of the rows includes at least three radiating elements, and wherein a second of the rows includes at least four radiating elements and has a larger number of radiating elements than the first of the rows, and wherein a third of the rows includes the same number of radiating elements as the first of the rows, wherein the second row is between the first and third rows;

an antenna feed network that is configured to couple at least a first input signal and a second input signal to all of the radiating elements in the first, second, and third rows of the antenna array; and wherein the antenna array is configured to generate a first beam that points in a first direction responsive to the first input signal and to generate a second beam that points in a second direction responsive to the second input signal.

2. The multi-beam cellular communication antenna of claim 1, wherein ones of the radiating elements in the first of the rows are aligned in a column direction that is perpendicular to a row direction with respective ones of the radiating elements in the third of the rows but are not so aligned with radiating elements in the second of the rows.

3. The multi-beam cellular communication antenna of claim 1, wherein a first distance between two adjacent radiating elements in the first of the rows is greater than a second distance between two adjacent radiating elements in the second of the rows.

4. The multi-beam cellular communication antenna of claim 1 further including a fourth row of radiating elements, wherein the fourth row is between the first and third rows and has the same number of radiating elements as the second row.

5. A dual-beam cellular communication antenna, comprising:

a plurality of radiators, each radiator including a dipole having a first polarization;

a plurality of modules that are spaced apart from each other along a vertical direction, each of the modules including a respective subset of the radiators, the radiators in each module being arranged in a horizontal row;

a first signal port;

a second signal port;

a first divider that connects the first signal port to each of the modules; and a second divider that connects the second signal port to each of the modules, wherein a first radiator in a first of the modules and a third radiator in a second of the modules define a first vertical line, a second radiator in the first of the modules that is directly adjacent the first radiator and a fourth radiator in the second of the modules that is directly adjacent the third radiator define a second first vertical line, and a fifth radiator in a third of the modules is between the first vertical line and the second vertical line so that at least some of the columns are staggered columns, and wherein the radiators are configured to generate a first antenna beam that points in a first direction and a second antenna beam that points in a second direction that is different from the first direction, the first and second antenna beams having the first polarization.

6. The dual-beam cellular communication antenna of claim 5, where the first antenna beam is configured to cover a first sector of a cell of the cellular communications system and the second antenna beam is configured to cover a second, different sector of the cell of the cellular communications system.

7. The dual-beam cellular communication antenna of claim 5, wherein each radiator further includes a dipole having a second polarization, the dual-beam cellular communication antenna further comprising:

a third signal port;

a fourth signal port;

a third divider that connects the third signal port to each of the modules; and a fourth divider that connects the fourth signal port to each of the modules, wherein the radiators are configured to generate third and fourth antenna beams having the second polarization, where the third antenna beam is configured to cover the first sector of the cell of the cellular communications system and the fourth antenna beam is configured to cover the second sector of the cell of the cellular communications system.

8. The dual-beam cellular communication antenna of claim 7, wherein each module includes a bidirectional beamforming network coupled between the first and second dividers and the dipoles having the first polarization.

9. The dual-beam cellular communication antenna of claim 8, wherein the bidirectional beamforming networks include a 2×3 beamforming network that is coupled to the third of the modules.

10. The dual-beam cellular communication antenna of claim 9, wherein the 2×3 beamforming network comprises a 90° hybrid coupler and a 180° splitter.

11. The dual-beam cellular communication antenna of claim 9, wherein the bidirectional beamforming networks include a 2×4 beamforming network that is coupled to the second of the modules.

12. The dual-beam cellular communication antenna of claim 5, wherein a first distance between two adjacent radiators in the first of the modules is less than a second distance between two adjacent radiators in the third of the modules.

13. The dual-beam cellular communication antenna of claim 5, wherein the third of the modules is an uppermost of the modules.

14. The dual-beam cellular communication antenna of claim 5, wherein the third of the modules is a lowermost of the modules.

15. The dual-beam cellular communication antenna of claim 5, wherein the third of the modules is between a lowermost of the modules and an uppermost of the modules.

16. A dual-beam cellular communication antenna, comprising:

a plurality of horizontal rows of radiators, wherein the radiators in a first of the horizontal rows of radiators and the radiators in a second of the horizontal rows of radiators that is directly adjacent the first of the horizontal rows of radiators define a plurality of parallel vertical lines and at least one of the radiators in a third of the horizontal rows of radiators is positioned between two adjacent ones of the vertical lines;

a first signal port;

a second signal port;

a first divider that connects the first signal port to each of the horizontal rows of radiators; and a second divider that connects the second signal port to each of the horizontal rows of radiators, wherein the radiators are configured to generate a first antenna beam that points in a first direction and a second antenna beam that points in a second direction that is different from the first direction.

17. The dual-beam cellular communication antenna of claim 16, wherein the first antenna beam is configured to cover a first sector of a cell of the cellular communications system and the second antenna beam is configured to cover a second, different sector of the cell of the cellular communications system.

18. The dual-beam cellular communication antenna of claim 16, further comprising a 2×3 beamforming network that is coupled to the first of the horizontal rows of radiators, the 2×3 beamforming network comprising a 90° hybrid coupler and a 180° splitter.

19. The dual-beam cellular communication antenna of claim 16, wherein a first distance between two adjacent radiators in the first of the horizontal rows of radiators is less than a second distance between two adjacent radiators in the third of the horizontal rows of radiators.

20. The dual-beam cellular communication antenna of claim 16, wherein the third of the horizontal rows of radiators is an uppermost of the horizontal rows of radiators.

21. The dual-beam cellular communication antenna of claim 16, wherein the third of the horizontal rows of radiators is a lowermost of the horizontal rows of radiators.

22. The dual-beam cellular communication antenna of claim 16, wherein the third of the horizontal rows of radiators is between a lowermost of the horizontal rows of radiators and an uppermost of the horizontal rows of radiators.

* * * * *